US006759990B2

(12) United States Patent
Rossman

(10) Patent No.: US 6,759,990 B2
(45) Date of Patent: Jul. 6, 2004

(54) COMPACT ANTENNA WITH CIRCULAR POLARIZATION

(75) Inventor: Court Rossman, Scotts Valley, CA (US)

(73) Assignee: Tyco Electronics Logistics AG (CH)

( * ) Notice: Subject to any disclaimer, the term of this patent is extended or adjusted under 35 U.S.C. 154(b) by 0 days.

(21) Appl. No.: 10/290,969

(22) Filed: Nov. 8, 2002

(65) Prior Publication Data

US 2004/0090371 A1 May 13, 2004

(51) Int. Cl.[7] ..... H01Q 1/38

(52) U.S. Cl. ..... 343/700 MS; 343/702; 343/895

(58) Field of Search ..... 343/700 MS, 702, 343/833, 846, 848, 893, 895

(56) References Cited

U.S. PATENT DOCUMENTS 5,796,372 A 8/1998 Elliot ..... 343/797
5,861,854 A * 1/1999 Kawahata et al. ..... 343/702
5,969,687 A 10/1999 Podger ..... 343/742
5,995,060 A 11/1999 Podger ..... 343/807
6,204,825 B1 3/2001 Wilz ..... 343/841
6,639,559 B2 * 10/2003 Okabe et al. ..... 343/700 MS
6,657,593 B2 * 12/2003 Nagumo et al. ..... 343/700 MS

* cited by examiner

*Primary Examiner*—Shih-Chao Chen
(74) *Attorney, Agent, or Firm*—Fulbright & Jaworski L.L.P.

(57) ABSTRACT

An efficient antenna exhibiting primarily circular polarization is described. Electrical performance is similar to that of a patch antenna having the same volume; however, greater bandwidth is achieved. The antenna consists of four radiating elements arranged in a semi-spiral configuration on a dielectric material, with a shunt feed system. The novel feed system incorporates a phase delay line, with two adjacent elements fed. The other two elements are parasitically coupled to the first two, with a 180 degree phase difference, resulting in a progressive phase shift of 90 degrees between the four elements. Circular polarization is a product of the symmetric geometry, as opposed to a circularly polarized patch antenna, which utilizes an offset feed. The antenna may be placed directly on a printed wiring board having a ground plane. The antenna is well suited for GPS applications and has a smaller major surface area than a patch antenna with comparable performance.

19 Claims, 4 Drawing Sheets

COMPACT ANTENNA WITH CIRCULAR POLARIZATION

FIELD OF THE INVENTION

The invention relates in general to antenna elements. More specifically, the invention relates to an antenna structure that exhibits circular polarization for wireless communications devices.

BACKGROUND

A variety of prior art antennas are currently used in wireless communication devices. One type of antenna is an external half wave single or multi-band dipole. This antenna typically extends or is extensible from the body of a wireless communication device (WCD) in a linear fashion. While this type of antenna is acceptable for use in conjunction with some WCDs, several drawbacks impede greater acceptance and use of such external half wave single or multiband dipole antennas. One significant drawback is that the antenna is typically mounted at least partially external to the body of a WCD which places the antenna in an exposed position where it may be accidentally or deliberately damaged, bent, broken, or contaminated.

Furthermore, due to the physical configuration of this class of onni-directional antenna, optimizing performance for a particular polarization and/or directional signal is not an option. That is, these types of prior art antennas are relatively insensitive to directional signal optimization or, said another way, these types of prior art antennas can operate in a variety of positions relative to a source signal without substantial signal degradation. This performance characteristic is often known as an "omni-directional" quality, or characteristic, of signal receipt and transmission. This means that electromagnetic waves radiate substantially equally in all directions during transmitting operations. Such prior art antennas also are substantially equally sensitive to receiving signals from any given direction (assuming adequate signal strength). Unfortunately, for a hand held WCD utilizing such a prior art antenna, the antenna radiates electromagnetic radiation toward a human user of the WCD equipped with such an antenna as there is essentially no front-to-back ratio. For reference, the applicant notes that for multi-band versions of prior art types of antenna, the external half wave single or multi-band dipole antenna (i.e., where resonances are achieved through the use of inductor-capacitor (LC) traps), signal gain on the order of approximately a positive two decibels (+2 dBi) are common and expected.

In addition, due mainly to the inherent shape of such prior art antennas, when operating they are typically primarily sensitive to receiving (and sending) vertical polarization communication signals and may not adequately respond to communication signals that suffer from polarization rotation due to the effects of passive reflection of the communication signals between source and receiver equipment. Furthermore, such prior art antennas are inherently inadequate in sensitivity to horizontal polarization communication signals.

Another type of prior art antenna useful with portable wireless communication gear is an external quarter wave single or multi-band asymmetric wire dipole. This type of antenna operates much like the aforementioned external half-wavelength dipole antenna but requires an additional quarter wave conductor to produce additional resonances and, significantly, suffers the same drawbacks as the aforementioned half wave single band, or multi-band, dipole antenna.

Therefore, the inventor recognizes and addresses herein a need in the art of WCD antenna design for an antenna assembly which is compact and lightweight, that is less prone to breakage and has no moving parts (which may fail, become bent, and/or misaligned), and, which utilizes the available interior spaces and structure of a WCD to achieve a more compact final configuration.

There is also a need for a multi-frequency antenna assembly which is able to receive and transmit circularly polarized electromagnetic radiation at one or more preselected operational frequencies.

There is also a need in the art for a deformable antenna resonator which is equally responsive to a variety of different communication signals having a variety of polarization orientations.

There also exists a need in the art for an antenna assembly which is compact and lightweight and which can receive and transmit electromagnetic signals at one or more discrete frequencies and which antenna assembly can be tuned to one or more frequencies.

A turnstile antenna consists of two resonant dipoles at right angles to each other and crossing in the center. The two antennas are electrically isolated from each other. The main feedline, such as a 50 Ohm coax, is coupled to one dipole's feedpoint connection. A 90 degree phasing line is provided between the one feedline connection to the other dipole feedline connection. The 90 degree phasing of the two dipoles is important toward obtaining an omnidirectional pattern.

The turnstile antenna is one of the many types that have been developed primarily for omnidirectional vhf communications. The basic turnstile consists of two horizontal half-wave dipole antennas mounted at right angles to each other in the same horizontal plane. When these tow antenna are excited with equal currents 90 degrees out of phase, the two antennas merge to produce a nearly circular radiation pattern.

Patch and quadrifilar helix antennas are used for applications such as GPS where circular polarization provides optimum link performance. Quadrifilar helix antennas are relatively large in size, and patch antennas, although much more compact, have the disadvantage of narrow bandwidth and are easily detuned due to their mode of operation.

SUMMARY OF THE INVENTION

The antenna of the present invention provides significant size advantages over known antenna structures, e.g, a smaller mounting footprint as compared to a patch antenna, and a height far less than a helix antenna, though somewhat greater than a dielectrically loaded patch. Electrical performance of the antenna of the present invention in a GPS application is similar to the helix and loaded patch antennas. An antenna according to the present invention is suitable for mass production. A dielectric base may be used, similar to a patch antenna; however, the material may be a low cost molded plastic for the present invention as opposed to a more expensive ceramic material.

A circularly polarized (CP) antenna is formed by a novel four arm resonator which may be placed relative to a conducting ground plane. The resonator has four conducting elements, each exhibiting quarter wave resonance in the band of interest. The elements are normally supported in a particular spatial relationship by a dielectric substrate or block, which is selected based on dielectric constant loss tangent, and thermal properties, as one skilled in the art would recognize. The elements are formed on the top and side surfaces of the dielectric block, and a microstrip transmission line with quarter wave delay portion is formed within the block, near the bottom. Two adjacent elements are fed with equal amplitude and 90 degree phase difference. The other two elements are parasitically excited from the opposite elements, with a 180 degree phase shift. A progressive phase shift of 90, 180, and 270 degrees between adjacent elements results in circular polarization. The primary feed location may be connected to a low impedance transmission line, becoming the input/output port of the antenna, and the other fed element is shunt fed through a quarter wavelength delay line. Shunt feed occurs on the sides of the block, near the ground plane, and the delay line is contained within the dielectric block. The feed system permits the use of a matching network if required, a feature not found in a patch antenna The resonator may be electrically connected to a conducting ground plane.

A microstrip or other type of transmission line on the ground plane may be used to feed the resonator. All electrical connections to the antenna may be surface mount type, which is facilitates automated installation. The antenna of the present invention may be manufactured at low cost and in high volume by a number of available methods. A two shot molded plastic with subsequent selective metallization is one, insert molded metal is another, and stamped metal parts attached to a dielectric block is a third.

An object of the present invention is to provide an antenna with elliptical and ideally circular polarization.

Another object of the present invention is to provide a circular polarization antenna having four elements, each element having two or more segments and exhibiting circular polarization derived at least in part from the geometry of the elements.

Another object of the present invention is to provide a circular polarization antenna having four elements, with two adjacent elements fed 90 electrical degrees apart, and their opposing elements parasitically excited with a 180 degree phase shift.

Another object of the present invention is to provide a circular polarization antenna of relatively small size, low cost, and suitable for high volume manufacture.

Another object of the present invention is to provide a circular polarization antenna suitable for surface mounting onto or within a wireless communication device such as a GPS receiver.

Another object of the present invention is to provide a circular polarization antenna constructed of conducting elements disposed on a dielectric base.

Yet another object of the present invention is to provide a circular polarization antenna which can easily accommodate an impedance matching network at its input/output port.

DETAILED DESCRIPTION OF THE DRAWINGS

Figure 1:
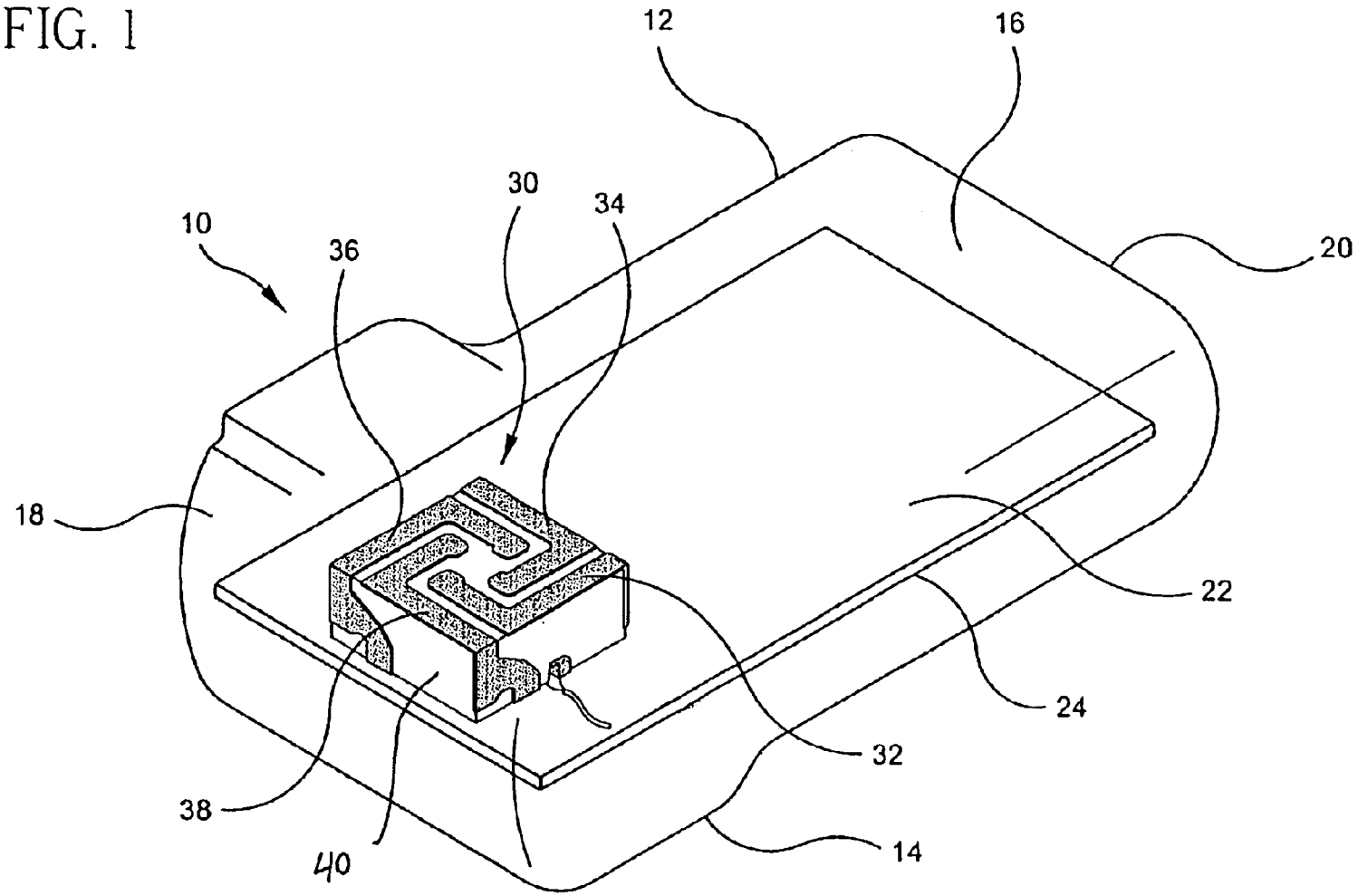
FIG. 1 is a perspective view of the antenna of the present invention, illustrating details on the top and two sides.

Referring now to the drawings, wherein like numerals depict like parts throughout, FIG. 1 illustrates a wireless communication device (WCD) 10 having a housing 12 with a front 14, a rear or back 16, a top 18, a bottom 20 and a printed wiring board (PWB) 22 disposed within said housing 12. PWB 22 supports a ground plane 24 and carries various RF signal generating components operatively connected to an antenna 30 during transmission and/or reception of RF signals. Ground plane 24 extends nominally a quarter wavelength radius in all directions. In FIG. 1, certain portions of the WCD 10 have been omitted to illustrate the juxtaposition of the antenna assembly 30 as it resides within the housing 12. As described in more detail herein, antenna assembly 30 comprises a plurality of conductive elements 32, 34, 36, 38 disposed upon a dielectric block structure 40. Each conductive element 32, 34, 36, 38 has an associated first conductor surface 50 which is generally parallel to ground plane 24 and a second conductor surface 52 (side surface) which is generally orthogonal to ground plane 24. As depicted, antenna assembly 30 is located adjacent the top 18 of the housing 12. This position optimizes operation because of the WCD 10 because it is an area which is not normally grasped by a human operator during use of the WCD 10. Antenna assembly 30 is preferably attached to PWB 22 with solder to soldering pads (not shown) disposed between antenna 30 and printed wiring board 22. It will be appreciated that the antenna 30 may be positioned at other locations within housing 12, however, though its operation may be less than optimal.

Figure 2:
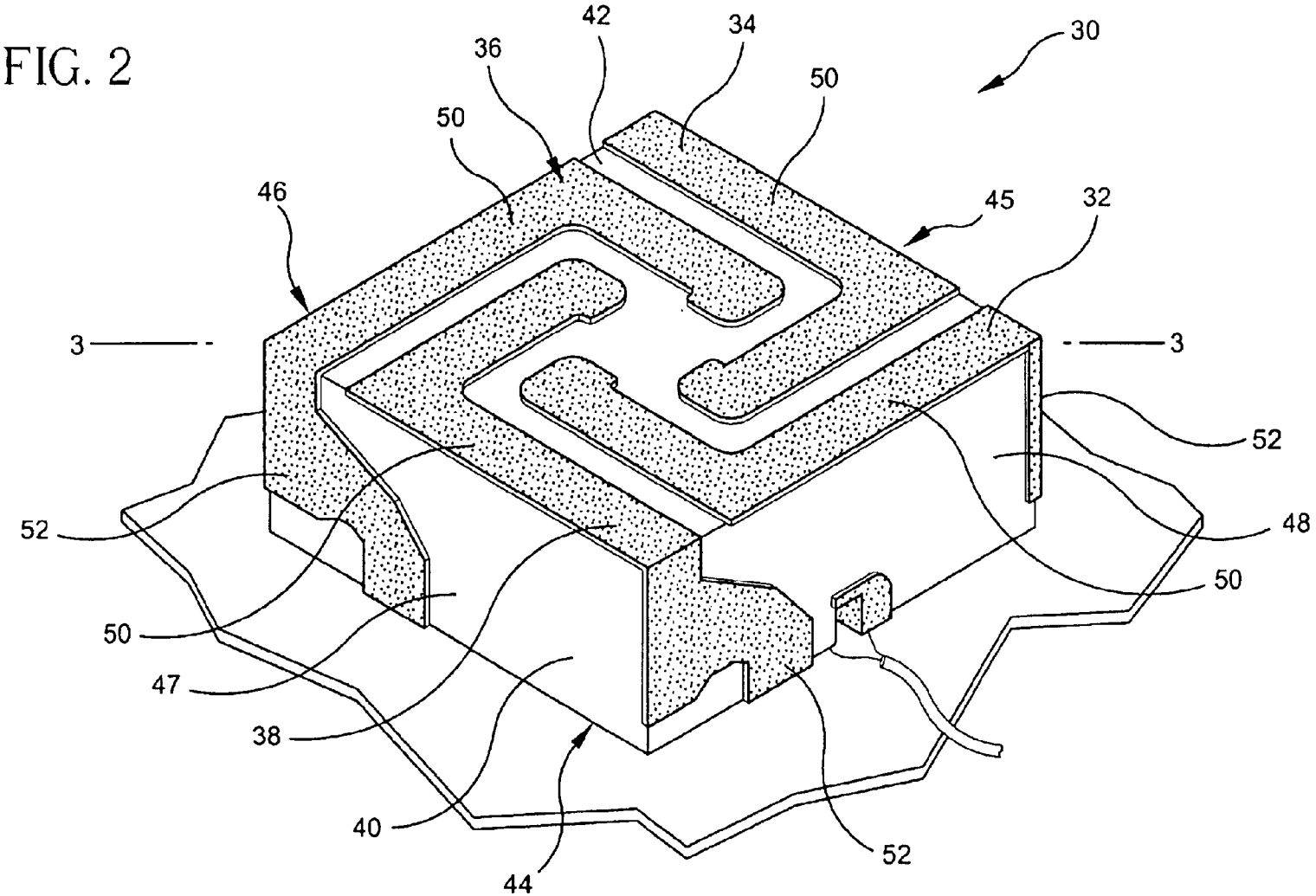
FIG. 2 is a perspective view of the antenna of FIG. 1 rotated 180 degrees about line 2—2, illustrating details on the bottom and two sides.

Referring to FIG. 2, a perspective view of one embodiment of antenna assembly 30 of the present invention is shown. Antenna 30 includes a dielectric block 40 having a top face 42, a bottom face 44, and a four side faces 45, 46, 47, 48. The antenna 30 includes a pair of fed conductive resonator elements 32, 34 and a pair of conductive parasitic elements 36, 38. Together the elements 32, 34, 36, 38 are generally symmetrically disposed relative to a center point. Each of the elements 32, 34, 36, 38 includes a conductive trace 50 on the top face 42 and a side face 52. Four semi-spiral conductors are shown. As illustrated in this embodiment, each top surface 50 includes a pair of orthogonal conductor portions, however alternative configurations may also be practicable and are intended to be within the scope of the appended claims. For example, top surface 50 may have other shapes, including a curved shape.

Conductors 32, 34, 36, 38 are shown supported in symmetrical proximity by a dielectric block 40, which may be plastic or other suitable material. The proximity of conductive surfaces 50 to each other is not critical, but must be sufficient to provide tight electrical coupling at the frequency range of interest. Ground plane 24 extends nominally a quarter wavelength radius in all directions. The selection of material for 40 is based on well-known and understood criteria such as dielectric constant, loss tangent, thermal properties, cost, ease of fabrication, and other factors such as the ability to receive metallization. Material used for 40 may have a dielectric constant in the range 1–10, which permits a wide selection of low loss materials. This is a distinct advantage with respect to small patch antennas, which require ceramic materials with dielectric constants in the range 10–80, which have higher loss tangents. The lower dielectric constant materials, coupled with the electrical design of the antenna of the present invention also provide a wider bandwidth than patches using ceramic dielectrics.

Figure 3:
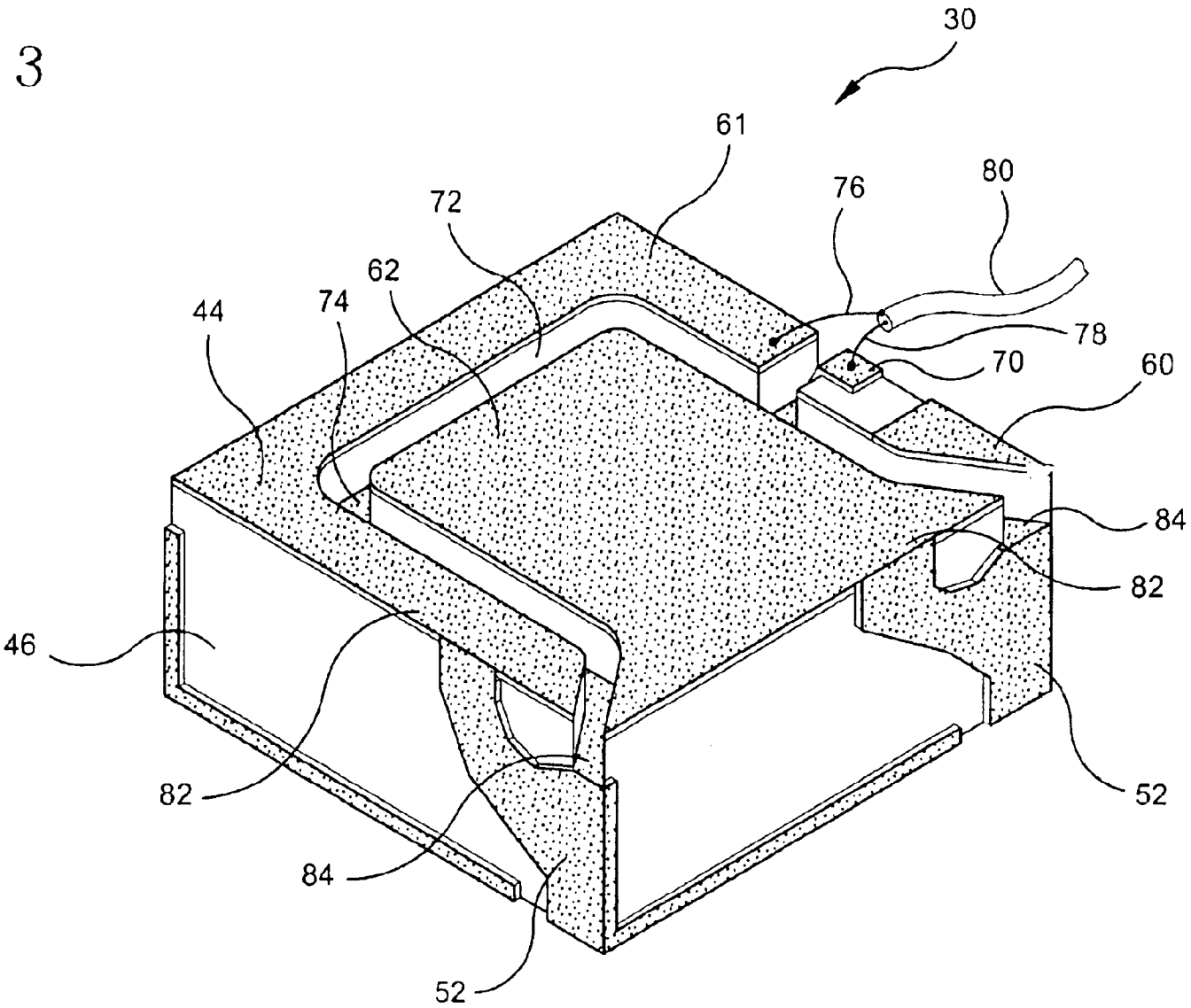
FIG. 3 is a plan view of the bottom side of the antenna of FIGS. 1 and 2.

Referring to FIG. 3, a perspective view of the antenna 30 of FIG. 2 rotated about line 3—3 is illustrated. This view shows the bottom face 44 and two sides 45, 46. Ground pads 60, 61 and 62 on the bottom face 44 are electrically connected to the ground plane 24; however, feed pad 70 must be isolated from 24. Ground pads 60, 61, 62 are substantially coextensive with the bottom face 44. Ground pad 60 is electrically coupled to side elements 52 of parasitic element 38. Ground pad 61 is electrically coupled to side element 52 of parasitic element 36. Slot 72 contains a quarter wavelength (¼λ) microstrip conductor 74, which feeds two legs 52 of conductor elements 32,34. Microstrip conductor 74 is a generally planar conductive element disposed in generally parallel relationship to the ground plane 24 of the PWB 22. Microstrip conductor 74 is illustrated as generally u-shaped, though alternative shapes and or configurations may also be practicable. The primary feed to the antenna 30 is across locations 76, 78. A coaxial feedline 80 is shown schematically as the primary feed for the antenna 30, although microstrip or other types of transmission line can be used in place of the coax feedline 80. Microstrip conductor 74 then feeds adjacent resonator elements 50 of elements 32 and 34 shown in this view. A shunt feed system at each element 32, 34 is shown, which consists of a ground connection 76 and a center conductor connection 70. The distance between the primary feed and the distant element is 90 electrical degrees longer than that to the nearest element. This phase difference and the spatial arrangement of the elements sets up a serial phase relationship between elements of 90, 180 and 270 degrees.

Figure 4:
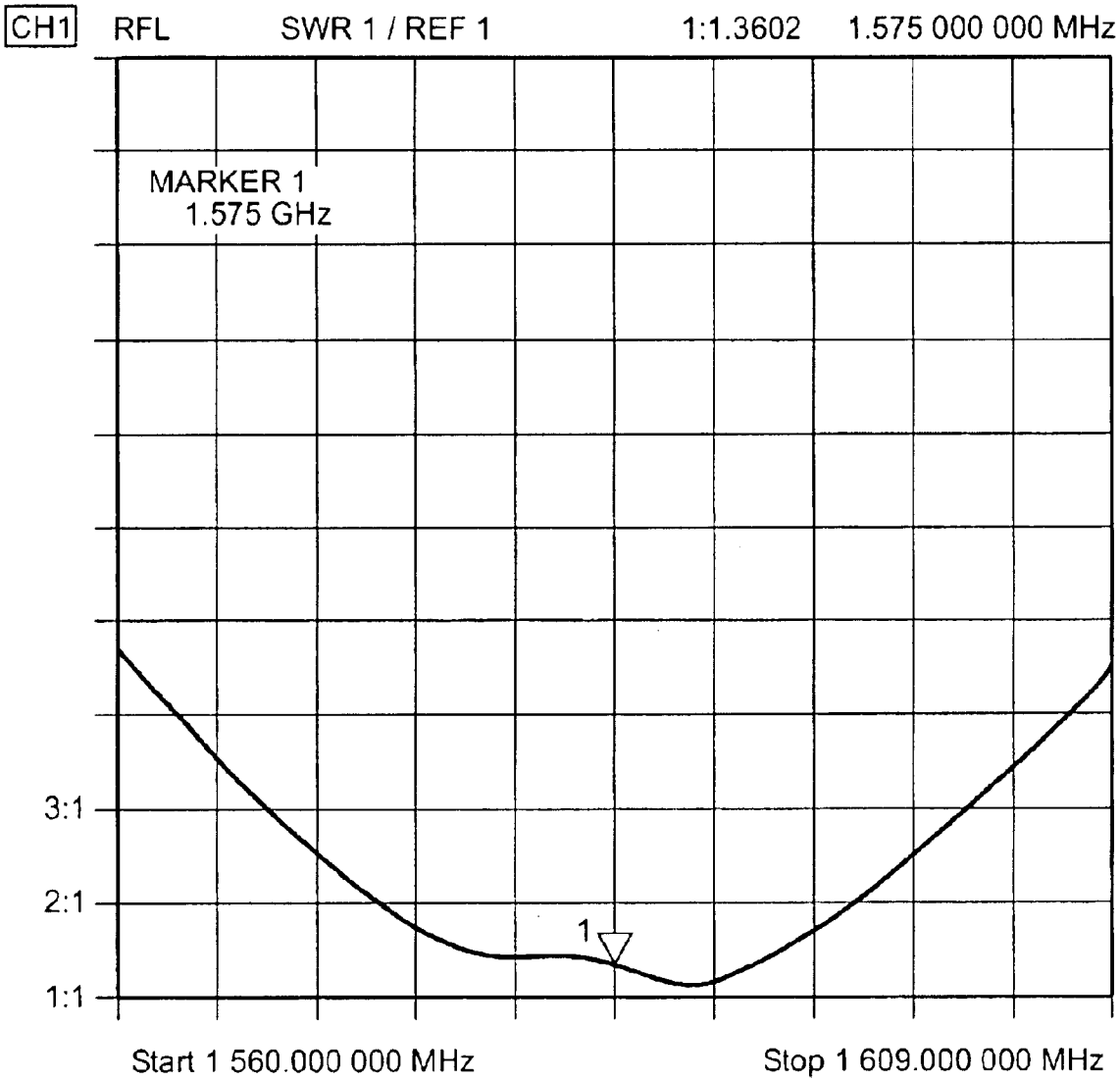
FIG. 4 is a plot of free space VSWR vs. frequency.

Referring to FIG. 4, the VSWR vs. frequency for the embodiment described in FIGS. 1–3 is shown, for the 1575 MHz GPS band, a 2-1 VSWR bandwidth is achieved, which provides a margin to accommodate physical tolerances expected during the manufacture of the antenna.

What is claimed is:

1. A circulation polarization antenna assembly for a wireless communications device having a signal line and a ground plane, said antenna assembly comprising, a plurality of symmetrically configured conductor elements, each including a first conductor surface being substantially parallel to the ground plane and a side element being substantially perpendicular to the ground plane, each of said plurality of conductor elements being oriented generally orthogonally relative to adjacent pairs of said plurality of conductor elements, each of said plurality of conductor elements being electrically coupled to the ground plane; and a feed conductor which operatively couples an adjacent pair of the plurality of conductor elements to the signal line.

2. The antenna assembly of claim 1, wherein the plurality of conductor elements are conductive surfaces disposed upon a dielectric substrate.

3. The antenna assembly of claim 1, wherein the plurality of conductor elements are four conductor elements, and each of the conductor elements are aligned along a respective edge of a rectangle.

4. The antenna assembly of claim 3, wherein the four conductor elements are disposed upon respective edges of a square dielectric substrate element.

5. The antenna assembly of claim 1, wherein the feed conductor is a one-quarter wavelength strip transmission line.

6. The antenna assembly of claim 1, wherein each first conductor surface includes a pair of generally orthogonal portions.

7. A compact circular polarization antenna assembly for a wireless communications device having a signal line and a ground plane, said antenna assembly comprising:

a plurality of conductor elements each having a first conductor surface being generally parallel with the ground plane and a second conductor surface being generally perpendicular to the ground plane, each of the plurality of conductor elements being coupled to the ground plane, said first conductor surfaces being provided in a circularly-nested orientation; and a feed conductor which operatively couples an adjacent pair of the plurality of conductor elements to the signal line.

8. The antenna assembly of claim 7, wherein the plurality of conductor elements are conductive surfaces disposed upon a dielectric substrate.

9. The antenna assembly of claim 7, wherein the plurality of conductor elements are four conductor elements, and each of the conductor elements are aligned along a respective edge of a rectangle.

10. The antenna assembly of claim 9, wherein the four conductor elements are disposed upon respective edges of a square dielectric substrate element.

11. The antenna assembly of claim 7, wherein the feed conductor is a one-quarter wavelength strip transmission line.

12. The antenna assembly of claim 7, wherein each first conductor surface includes a pair of generally orthogonal portions.

13. A compact circular polarization antenna assembly for a wireless communications device having a signal line and a ground plane, said antenna assembly comprising:

a dielectric substrate element having a plurality of sides;

a plurality of conductor elements each having a first conductor surface being generally parallel with the ground plane and a second conductor surface being generally perpendicular to the ground plane, each of the plurality of conductor elements being coupled to the ground plane, each of the plurality of conductor elements being associated with a different one of the plurality sides of the dielectric substrate element; said first conductor surfaces being provided in a circularly-nested orientation; and a feed conductor which operatively couples an adjacent pair of the plurality of conductor elements to the signal line.

14. The antenna assembly of claim 13 wherein the dielectric substrate element is a rectangular-shaped element.

15. The antenna assembly of claim 13 wherein each second conductor surface of each of the plurality of conductor elements is associated with a different side of the dielectric substrate element.

16. The antenna assembly of claim 13 wherein the feed conductor is a one-quarter wavelength strip transmission line.

17. The antenna assembly of claim 13 wherein the plurality of conductor elements are four conductor elements with two of the conductor elements being driven elements and the other two of the conductor elements being parasitic elements.

18. The antenna assembly of claim 13 wherein the first conductor surface includes a pair of generally orthogonal conductive portions.

19. The antenna assembly of claim 13 wherein all of the first conductor surfaces of the plurality of conductor elements are generally coplanar.

* * * * *